US009370226B2

(12) United States Patent
Dole et al.

(10) Patent No.: US 9,370,226 B2
(45) Date of Patent: Jun. 21, 2016

(54) CANE WITH GRASPING FINGERS

(71) Applicant: Snapper Cane, LLC, West Chester, PA (US)

(72) Inventors: Charles Minot Dole, Shelburne, VT (US); Paul Joseph McMahon, Waltham, VT (US); Daniel Byrne, West Chester, PA (US)

(73) Assignee: Snapper Cane, LLC, West Chester, PA (US)

( * ) Notice: Subject to any disclaimer, the term of this patent is extended or adjusted under 35 U.S.C. 154(b) by 0 days.

(21) Appl. No.: 14/609,593

(22) Filed: Jan. 30, 2015

(65) Prior Publication Data

US 2015/0250275 A1 Sep. 10, 2015

Related U.S. Application Data

(60) Provisional application No. 61/950,582, filed on Mar. 10, 2014.

(51) Int. Cl.
*A45B 3/00* (2006.01)
*A61H 3/02* (2006.01)

(52) U.S. Cl.
CPC ..... *A45B 3/00* (2013.01); *A61H 2003/0222* (2013.01)

(58) Field of Classification Search
CPC ..... A61H 3/02; A61H 2201/1635; A61H 2003/0222; A45B 3/00; A45B 9/02; B25J 1/04
USPC ..... 135/65–66, 70, 72, 84; 294/104, 86.29
See application file for complete search history.

(56) References Cited

U.S. PATENT DOCUMENTS

| | | | |
|---|---|---|---|
| 465,222 | A | 12/1891 | Ulbricht |
| 1,905,076 | A | 4/1933 | Sciver |
| 2,346,038 | A | 4/1944 | Mason |
| 2,836,188 | A | 5/1958 | Jordan |
| 2,891,811 | A | 6/1959 | Strickler |
| 3,093,402 | A | 6/1963 | Sisson |
| 3,105,715 | A | 10/1963 | Happ |
| 3,146,015 | A | 8/1964 | Roberge |
| 3,265,429 | A | 8/1966 | Shatt |
| 3,467,116 | A | 9/1969 | Ringewaldt |
| 3,763,872 | A | 10/1973 | Gooley |
| 4,056,278 | A | 11/1977 | Bau et al. |
| 4,200,322 | A | 4/1980 | Smith |
| 4,299,246 | A | 11/1981 | Marsh |
| 4,575,143 | A | 3/1986 | Nast |

(Continued)

*Primary Examiner* — Winnie Yip
(74) *Attorney, Agent, or Firm* — Stradley Ronon Stevens & Young, LLP

(57) ABSTRACT

A cane with grasping fingers. The cane includes a hollow shaft having a first end and a second end, a grasping mechanism within the first end of the shaft, and a release mechanism adjacent to the second end of the shaft. The release mechanism includes a handle, a trigger within the handle, and a release button. Pressing the release button extends the trigger beyond the handle and extends the grasping fingers beyond the first end of the shaft so that the grasping fingers are separated by a first distance. Squeezing the handle retracts the grasping fingers and reduces the distance between the grasping fingers to a second distance less than the first distance. Squeezing the handle so that the grasping fingers are fully retracted into the first end of the shaft results in the trigger and the grasping mechanism being locked into place until the release button is pressed again.

13 Claims, 8 Drawing Sheets

(56) References Cited

U.S. PATENT DOCUMENTS

| | | | | |
|---|---|---|---|---|
| 4,589,681 | A * | 5/1986 | Erickson | A63C 11/001 135/66 |
| 4,811,750 | A | 3/1989 | McAllister | |
| 4,827,956 | A | 5/1989 | Toot | |
| 5,176,160 | A | 1/1993 | Osborn | |
| 5,392,800 | A | 2/1995 | Sergi | |
| 5,410,835 | A * | 5/1995 | Vetter | F41A 23/06 42/94 |
| 5,433,234 | A | 7/1995 | Lapere | |
| 5,628,538 | A * | 5/1997 | Ericksen | A01K 97/24 294/210 |
| 5,636,650 | A | 6/1997 | Kroeze | |
| 5,640,985 | A | 6/1997 | Snyder et al. | |
| 6,058,953 | A | 5/2000 | Stefanelli | |
| 6,386,216 | B1 | 5/2002 | Cubelli | |
| 6,513,844 | B1 * | 2/2003 | Hsu | B25J 1/04 294/115 |
| 6,550,490 | B1 | 4/2003 | Morton et al. | |
| 6,951,224 | B2 | 10/2005 | Garrett | |
| 7,243,668 | B1 | 7/2007 | Kroeze | |
| 7,252,104 | B1 | 8/2007 | Anderwald | |
| 7,287,675 | B1 | 10/2007 | Sullivan et al. | |
| 7,624,746 | B2 | 12/2009 | Blake | |
| 7,934,756 | B2 | 5/2011 | Kroeze | |
| 8,122,900 | B1 | 2/2012 | Hayes et al. | |
| 8,381,748 | B2 | 2/2013 | Martin | |
| 8,590,440 | B2 * | 11/2013 | Gallo | A45B 3/00 135/66 |
| 2004/0040588 | A1 * | 3/2004 | Parigian | A45B 3/00 135/66 |
| 2006/0266397 | A1 | 11/2006 | Berl | |
| 2009/0145470 | A1 * | 6/2009 | Couper | A45B 1/04 135/66 |
| 2011/0061696 | A1 * | 3/2011 | Wilson | A45B 1/04 135/66 |
| 2012/0060878 | A1 | 3/2012 | Thiessens | |
| 2013/0257072 | A1 | 10/2013 | Chrysler | |
| 2014/0240963 | A1 * | 8/2014 | Roberts | A45B 3/00 362/102 |

* cited by examiner

CANE WITH GRASPING FINGERS

RELATED APPLICATION

This application claims the benefit of priority to U.S. Provisional Patent Application Ser. No. 61/950,582, filed on Mar. 10, 2014, the contents of which are incorporated in this application by reference.

TECHNICAL FIELD

The present invention relates generally to canes with grasping fingers, particularly to a walking cane having grasping fingers that retract into the body of the cane when not in use and a trigger mechanism to operate the grasping fingers.

BACKGROUND OF THE INVENTION

Canes, or walking sticks, are commonly used as support, for example, by people suffering from various injuries, infirmities, or physical disabilities that limit their ability to stand or walk without assistance. In many instances, these disabilities also prevent the person from bending over or reaching to pick up objects, for example picking up an object off the floor while in a standing position. As a result, a grabbing device may also be used in addition to the cane. However, the use of two devices is cumbersome and inefficient. It is therefore desirable to produce a single device capable of functioning as both a cane and as a grabbing device.

SUMMARY OF THE INVENTION

Embodiments of the present invention include canes with grasping fingers that retract into the body of the cane when not in use and a trigger mechanism to operate the grasping fingers. The cane may include a hollow shaft having a first end and a second end, a grasping mechanism within the first end of the shaft, and a release mechanism adjacent to the second end of the shaft including a handle, a trigger within the handle, and a release button. Pressing the release button extends the trigger beyond the handle and extends the grasping fingers beyond the first end of the shaft so that the grasping fingers are separated by a first distance. Squeezing the handle retracts the grasping fingers and reduces the distance between the grasping fingers to a second distance less than the first distance. Squeezing the handle so that the grasping fingers are fully retracted into the first end of the shaft results in the trigger and the grasping mechanism being locked into place until the release button is pressed again.

In some embodiments, the cane may further include a release cylinder adjacent to the release button, the release cylinder having a release pin located beneath a portion of the trigger, where pressing the release button laterally displaces the release pin from beneath the portion of the trigger, resulting in the trigger extending beyond the handle, and a spring between the release button and the release cylinder to maintain tension on the release button.

In some embodiments, the cane may also further include a linkage shaft connecting the trigger of the grasping mechanism to the plurality of grasping fingers of the grasping mechanism, an upper bushing attached to an interior surface of the shaft at a height above the connection between the linkage shaft and the grasping mechanism, a lower bushing adjacent to the connection between the linkage shaft and the grasping mechanism, and a bushing spring attaching the upper bushing and the lower bushing. The bushing spring is compressed while the grasping mechanism is stored in the hollow shaft so that when the release button is pressed the bushing spring expands and pushes the grasping mechanism beyond the second end of the shaft.

In some embodiments, the cane further includes a detachable hook assembly including a bracket sized to fit around the hollow shaft, a handle, and a thumb screw assembly. The thumb screw assembly may be tightened to increase tension on the hollow shaft. The bracket includes a bracket body, a handle aperture, a shaft aperture sized to fit around the hollow shaft, and a screw aperture, where the handle fits into the handle aperture, and the thumb screw assembly fits in the screw aperture. The handle includes a hook and a connecting region with a handle shaft having a diameter approximately equal to a diameter of the handle aperture, a foot offset from the handle shaft, and a flexible connecting member connecting the handle shaft to the hook. When the connecting region is inserted into the handle aperture, the foot extends beyond the handle aperture and prevents an upward force from removing the handle from the handle aperture. The handle may be removed from the handle aperture by pressing the foot inward toward the handle aperture, causing the flexible connecting member to bend and aligning the foot with the handle aperture.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1:
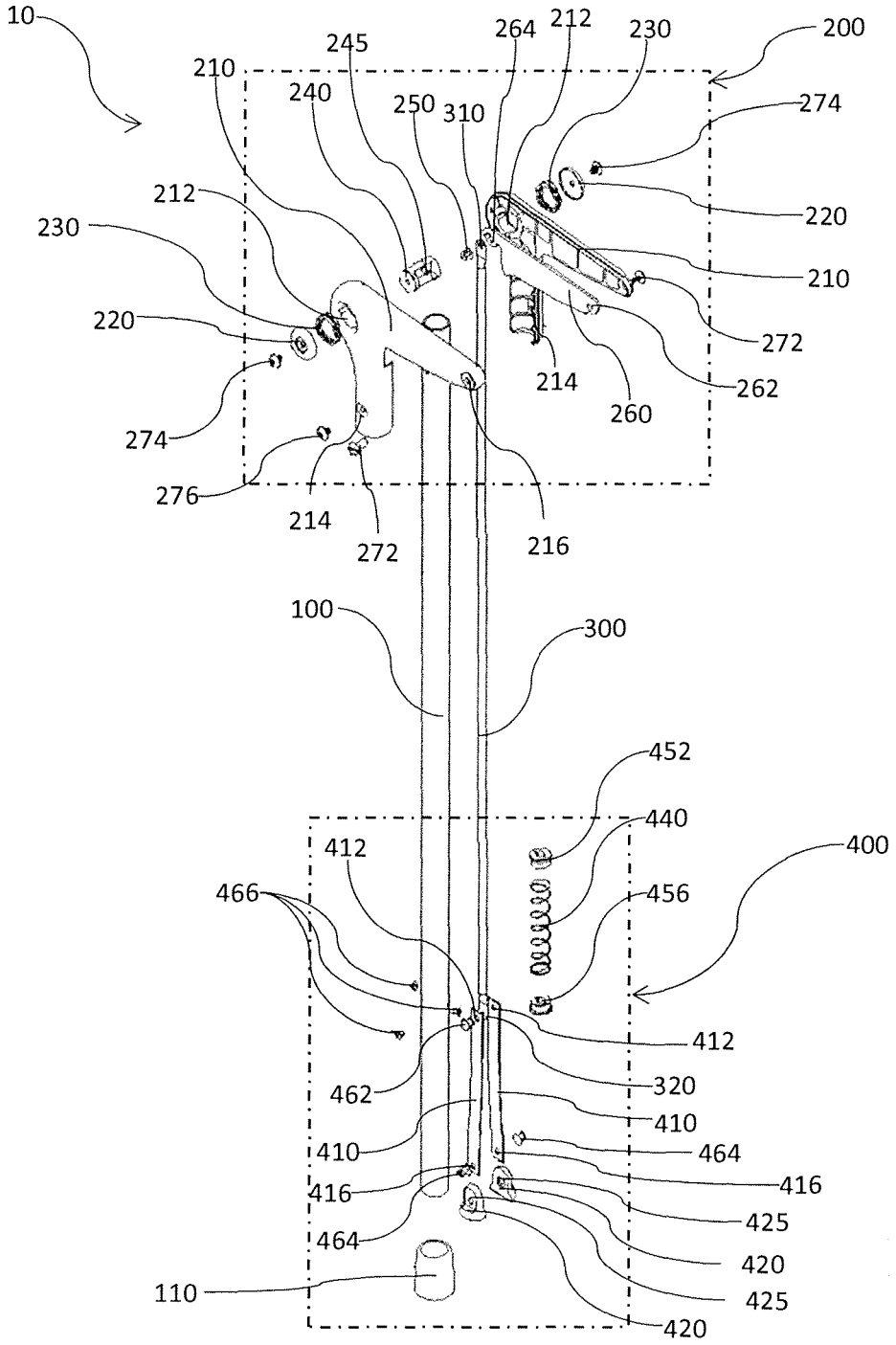
FIG. 1 is an exploded view of a cane with grasping fingers, according to an exemplary embodiment of the present invention.

Referring now to the drawing, in which like reference numbers refer to like elements throughout the various figures that comprise the drawing, embodiments of the present invention include a cane with grasping fingers that retract into the cane when not in use. The cane further includes a release button to extend the grasping fingers from within the cane and release a trigger mechanism from a handle of the cane, where the trigger mechanism operates the grasping fingers.

Referring to FIG. 1, an exemplary embodiment of the present invention includes a cane 10. The cane 10 includes a hollow external shaft 100 displaced between a handle mechanism 200 and a grasping mechanism 400. The handle mechanism 200 is connected to the grasping mechanism 400 by a linkage shaft 300 contained within the hollow interior of external shaft 100. When not in use, the grasping mechanism 400 may be retracted into the external shaft 100. To use the grasping mechanism 400, a user may press a release button 220 of the handle mechanism 200 to extend the grasping mechanism 400 beyond the external shaft 100 and release a trigger 260 of the handle mechanism 200, and then squeeze the trigger 260 to operate the grasping mechanism 400. The external shaft 100 may further include a cane tip 110, for example to provide a stable support surface and protect the end of the external shaft 100. If present, the cane tip 110 includes an internal bore through which the grasping mechanism 400 can pass. The components and operation of the handle mechanism 200 and the grasping mechanism 400 are described in the paragraphs below in conjunction with FIG. 1 and additional FIGS. 2-4. The cane 200 may further include a detachable hook assembly, described below in conjunction with FIGS. 5-9B.

Figure 2A:
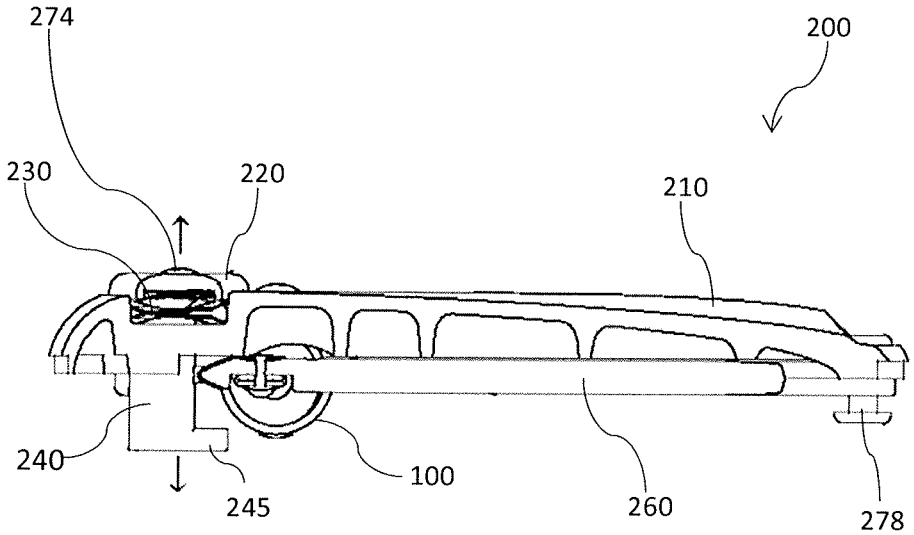
FIG. 2A is a cross-sectional top view of the handle assembly of the cane of FIG. 1, according to an exemplary embodiment of the present invention.
Figure 2B:
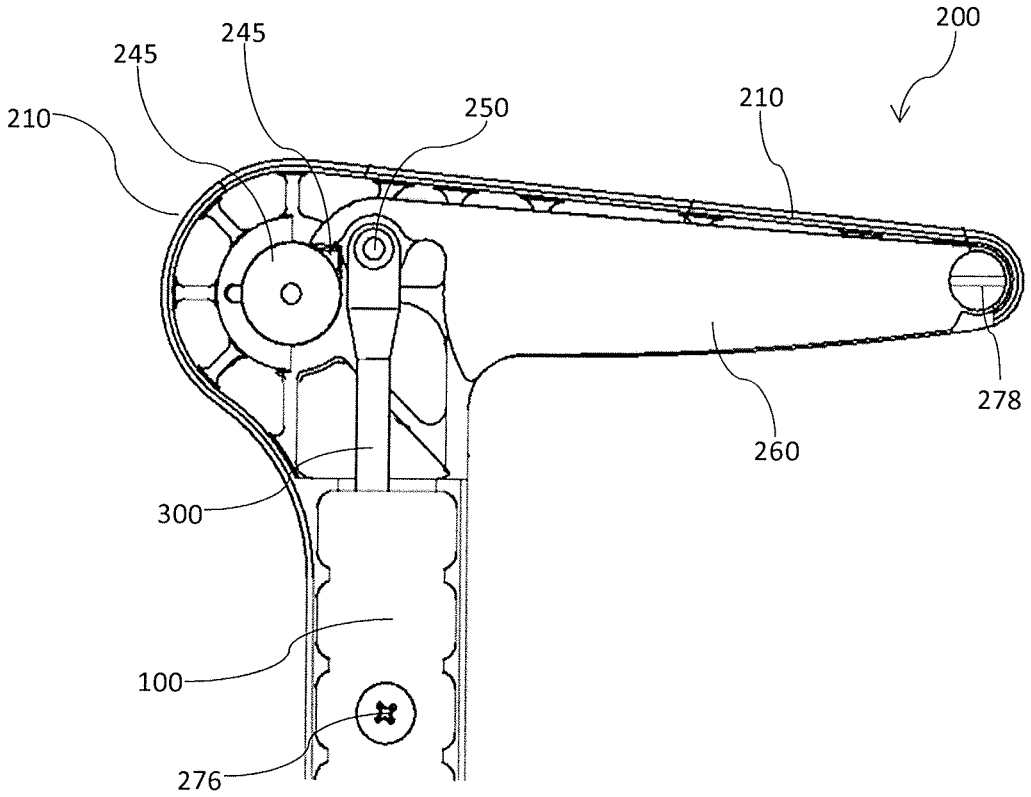
FIG. 2B is a cross-sectional side view of the handle assembly of the cane of FIG. 1, according to an exemplary embodiment of the present invention.
Figure 10A:
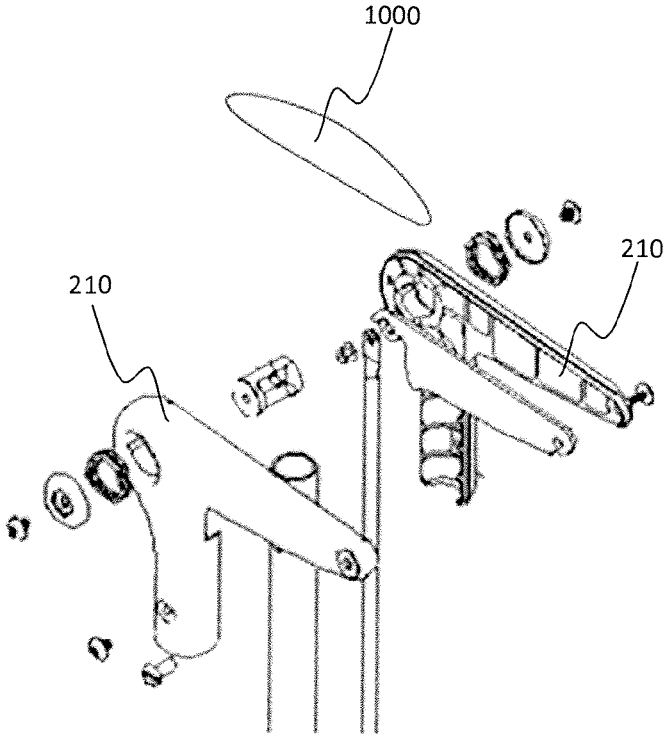
FIG. 10A is an exploded view of a cane with a gel insert attached to a handle, according to an exemplary embodiment of the present invention.
Figure 10B:
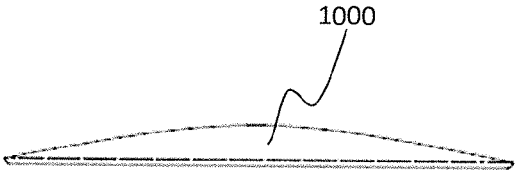
FIG. 10B is a side view of the gel insert of FIG. 10A, according to an exemplary embodiment of the present invention.
Figure 10C:
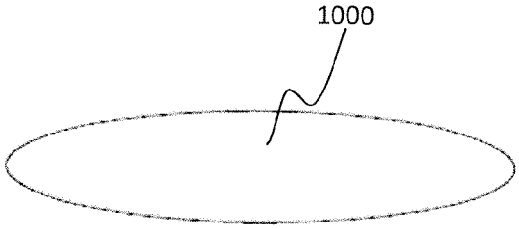
FIG. 10C is a top view of the gel insert of FIG. 10A, according to an exemplary embodiment of the present invention.

Continuing to refer to FIG. 1, and also referring to FIGS. 2A and 2B, the handle mechanism 200 further includes a handle, for example, formed from handle halves 210 attached to the external shaft 100 by a handle fastener 276 passing through first handle holes 214 in the handle halves 210. In other embodiments, the handle may be a solid piece (not shown) attached to the external shaft 100 by the handle fastener 276, or alternatively, attached to the external shaft 100 by other mechanisms, for example gluing or welding. Throughout the description, "fastener" may refer to any suitable mechanism to attach the respective elements, including, but not limited to, screws, bolts, and rivets. Although "fastener" is also used in the singular throughout the description, each fastener may include more than one element, for example a nut and a bolt. In some embodiments, the handle may further include a gel insert 1000, as depicted in FIGS. 10A-10C, for example, to increase the comfort of a user operating the cane 10. The trigger 260 is contained between the handle halves 210 and attached to an end of the handle opposite the external shaft by a trigger fastener 272 passing through second handle holes 216 in the handle halves 210 and a first trigger hole 262 in the trigger 260, so that the handle may pivot about the trigger fastener 272. In an exemplary embodiment, the trigger fastener 278 may include a sex bolt and an accompanying machine screw. The end of the trigger 260 opposite the trigger fastener 272 is attached to the linkage shaft 300 by a linkage fastener 250 passing through a second trigger hole 264 of the trigger 260 and a handle-end hole 310 of the linkage shaft 300.

Adjacent to the junction of the linkage shaft 300 and the trigger 260 within the handle mechanism 200 is a release mechanism including release buttons 220, release springs 230, and a release cylinder 240. The release buttons 220, the release springs 230, and the release cylinder 240 may be secured within release mechanism holes 212 of the handle halves 210 by a release fastener 274. As can be seen particularly in FIG. 2B, the release cylinder 240 includes a release pin 245 that supports the trigger 260 in a raised position. When the release button 220 on either side of the handle halves 210 is depressed by a user, the release cylinder 240 shifts laterally within the handle mechanism 200 to move the release pin 245 from below the trigger 260. This allows the trigger 260, and accordingly the attached linkage shaft 300, to move downwardly, extending the trigger 260 beyond the contour of the handle halves 210 and extending the grasping mechanism 400 beyond the external shaft 100 into a usable position. The trigger 260 in the extended position blocks the release pin 245 from returning to its original position until the trigger 260 is moved upwardly into its stored position within the handle halves 210. The release springs 230 provide tension on the release buttons 220 to prevent inadvertent activation of the handle mechanism 200.

Figure 3:
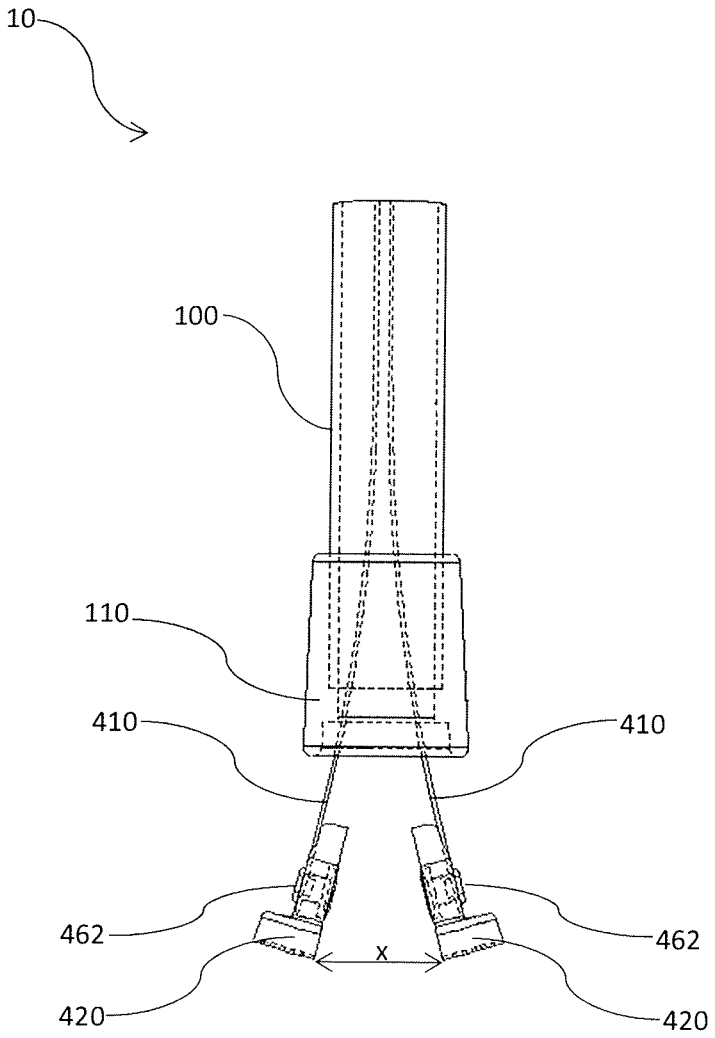
FIG. 3 is a side view of the retractable grasping fingers of the cane of FIG. 1, according to an exemplary embodiment of the present invention.

Continuing to refer to FIG. 1, and also referring to FIG. 3 (depicting the grasping mechanism 400 in the usable position), the grasping mechanism 400 includes two or more grasping fingers 410 attached to the linkage shaft 300 by a finger fastener 462 passing through linkage fastener holes 412 in the grasping fingers 410 and a grasping-end hole 320 in the linkage shaft 300. The grasping fingers 410 may be made of any suitable material, for example stainless steel or plastic. Although the embodiment depicted in FIGS. 1-4 includes a pair of the grasping fingers 410, other embodiments may include three or more grasping fingers. Some embodiments may include grasping tips 420 attached to the exposed ends of the grasping fingers 410 by a tip fastener 464 passing through tip fastening holes 416 in the grasping fingers 410 and finger fastening holes 425 in the grasping tips 420. To increase the gripping ability of the cane 10, the grasping tips 420 may be made of a non-skid material such as rubber, or be textured to prevent slipping. The grasping fingers 410 are flexible and bent outward from the external shaft 100, so that the grasping fingers 410 are separated by a distance x when extended beyond the external shaft 100, but are drawn together when the linkage shaft 300 is moved upwardly. In an exemplary embodiment, the distance x may be approximately 1.5 inches, though greater and lesser distances are explicitly contemplated.

To operate the cane 10, a user may first press one of the release buttons 220 to extend the trigger 260 and the grasping mechanism 400 into the usable position, as previously described. Once extended, the user may place an object to be picked up between the grasping fingers 410 and squeeze the trigger 260 to raise the linkage shaft 300 and retract the grasping fingers 410, thereby securing the object between the grasping fingers 410. Because the object prevents the grasping fingers 410 from coming into contact, the grasping mechanism 400 is prevented from fully retracting into the external shaft 100. The user may then maneuver the cane 10 while maintaining pressure on the trigger 260 to the move the object into a desired position. Releasing the trigger 260 will release the object. After releasing the object, the user may again squeeze the trigger, this time with no object between the grasping fingers 410, to retract the grasping mechanism 400. Once the trigger 260 is raised to its stored position, the release pin 245 will slide back to its original position beneath the trigger 260, locking the trigger 260, and thereby the attached linkage shaft 300 and grasping mechanism 400, into the stored position within the cane 10.

Figure 4:
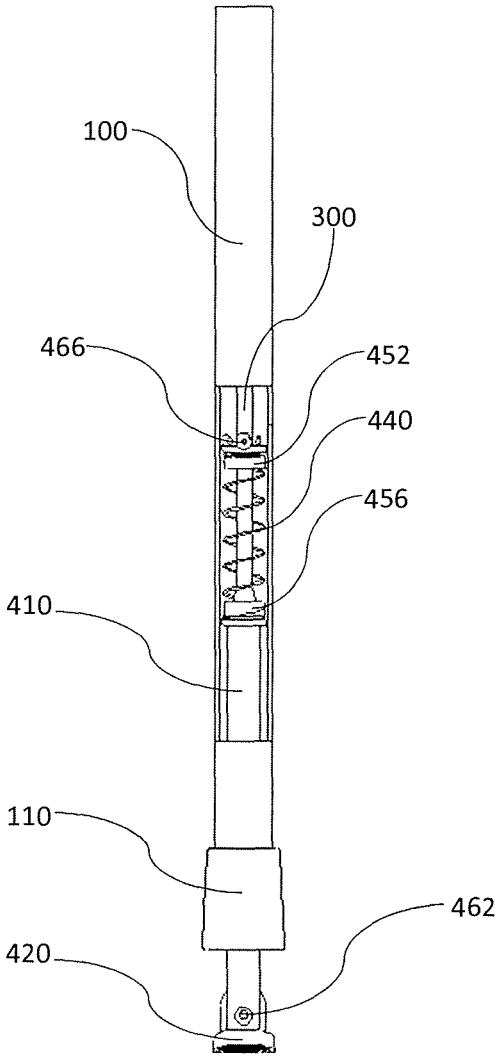
FIG. 4 is a cut-away side view depicting the spring assembly contained within the shaft of the cane of FIG. 1, according to an exemplary embodiment of the present invention.

Continuing to refer to FIG. 1, and also referring to FIG. 4, the grasping mechanism 400 may further include an a spring loaded mechanism including a bushing spring 440 displaced around the linkage shaft 300 and attached to an upper bushing 452 and a lower bushing 456. A bushing fastener 466, for example a plurality of rivets, may be attached to an interior surface of the outer shaft 100 at a height above the junction between the linkage shaft 300 to limit the travel of the upper bushing 452. When the grasping mechanism 400 is in its stored position, the spring 440 will be compressed, so that when the release button 220 is pressed, the spring 440 expands and the resulting force pushes the lower bushing 456, and thereby the grasping fingers 410, downward. Accordingly, the grasping mechanism 400 may be extended beyond the external shaft 100 by the force of the spring 440 and not only by the force of gravity, allowing the grasping mechanism 400 to be extended in substantially non-vertical positions.

Figure 5:
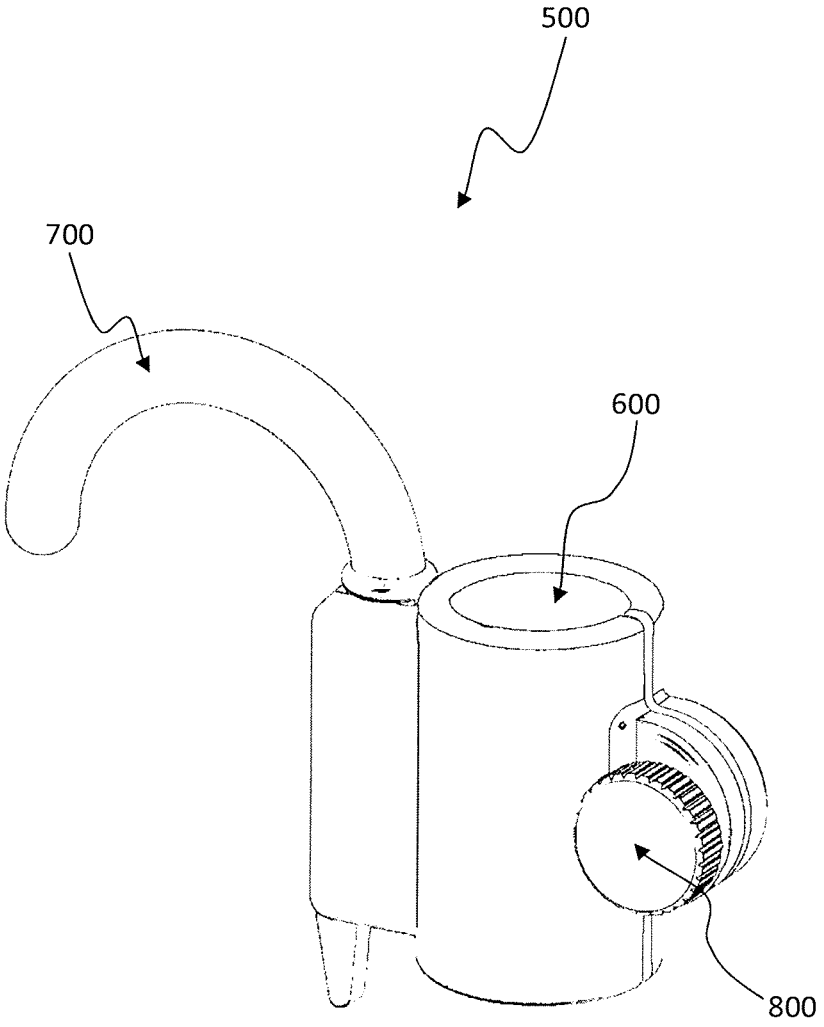
FIG. 5 is a perspective view of a detachable hook assembly, according to an exemplary embodiment of the present invention.

Referring to FIG. 5, the cane 10 (FIGS. 1-4) may further include a detachable hook assembly 500 to further increase usability of the cane 10. The detachable hook assembly 500 may include a bracket 600 and a hook 700 attached to the cane 10 to allow a user to, for example, hang the cane 10 from a chair or doorknob when not in use while keeping the cane within reach and readily accessible. The hook 700 fits into the bracket 600 which is sized to fit around the external shaft 100 (FIG. 1) of the cane 10. The detachable hook assembly 500 further includes a thumb screw assembly 800 which, when tightened, increases the tension of the bracket 600 on the external shaft 100 to securely attach the detachable hook assembly 500 to the external shaft 100. By loosening the thumb screw assembly 800, the detachable hook assembly 500 may be moved up or down the external shaft 100 to adjust the height of the detachable hook assembly 500 or to fully remove the detachable hook assembly 500 from the cane 10. The thumb screw assembly 800 may include a threaded cylinder 810 (FIGS. 8A and 8B) having a body 812 and an opening 814 and an oppositely threaded screw 820 (FIGS. 9A and 9B) sized to fit in the opening 814 of the threaded cylinder 810. The screw 820 may include a threaded shaft 826 which screws into the opening 814 attached to a body 822. The body 822 may include a grooved or textured outer surface 824 to improve grip.

Figure 6A:
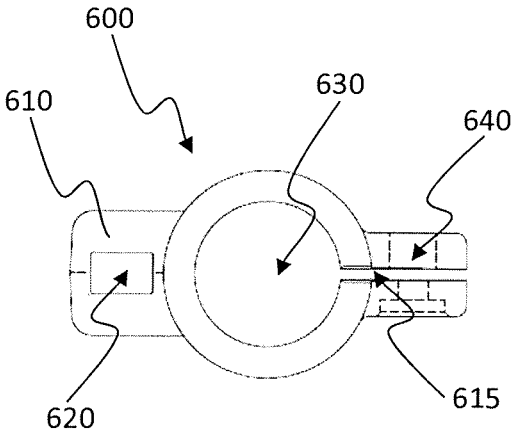
FIG. 6A is a top view of a bracket forming part of the detachable hook assembly of FIG. 5, according to an exemplary embodiment of the present invention.
Figure 6B:
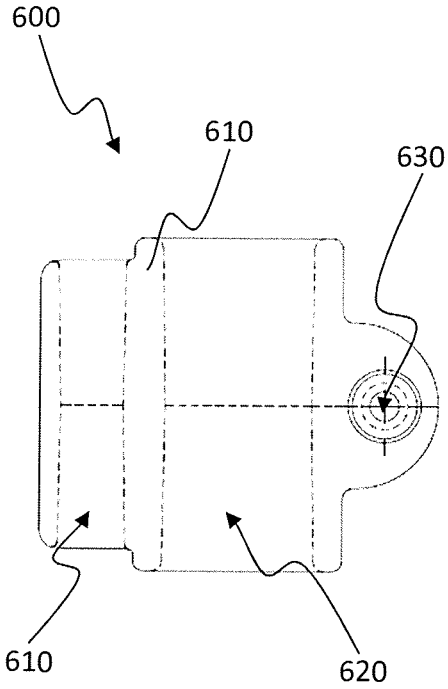
FIG. 6B is a side view of the bracket of FIG. 6A, according to an exemplary embodiment of the present invention.

Referring to FIGS. 6A and 6B, the bracket 600 includes a bracket body 610 defining three apertures or holes in the bracket 600: a hook aperture 620, a shaft aperture 630, and a screw aperture 640. When the bracket 600 is attached to the external shaft 100 (FIG. 1) of the cane 10, the hook aperture 620 and the shaft aperture 630 are aligned parallel to the length of the external shaft 100 and the screw aperture 640 is aligned approximately perpendicular to the length of the external shaft 100. Adjacent to the screw aperture 640, the bracket body 610 may be divided into two pieces separated by a notch 615 so that the bracket body 610 may expand slightly to increase the area of the shaft aperture 630 to accommodate the external shaft 100. In some embodiments, the bracket body 610 may include separate halves sized to fit around the external shaft 100. In further embodiments, the bracket body 610 may include a hinge attaching the separate halves of the bracket body 610.

Figure 7A:
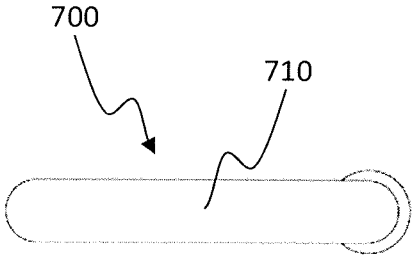
FIG. 7A is a top view of a hook forming part of the detachable hook assembly of FIG. 5, according to an exemplary embodiment of the present invention.
Figure 7B:
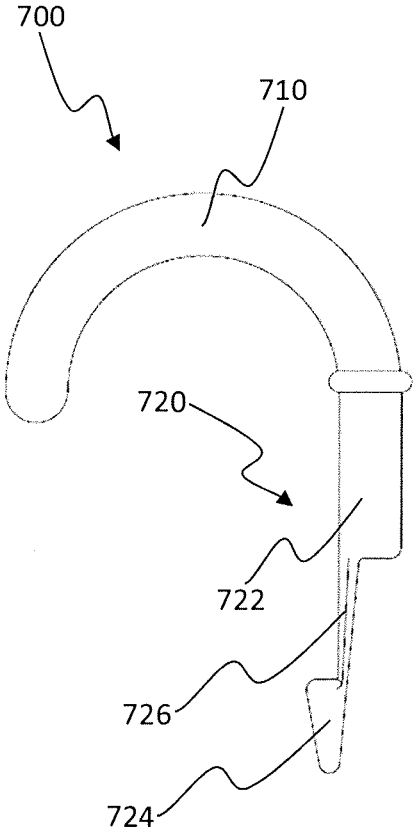
FIG. 7B is a side view of the hook of FIG. 7A, according to an exemplary embodiment of the present invention.
Figure 8A:
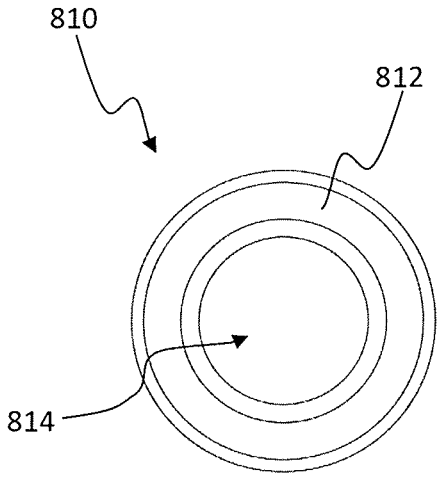
FIG. 8A is an end view of a threaded insert forming part of the detachable hook assembly of FIG. 5, according to an exemplary embodiment of the present invention.
Figure 9A:
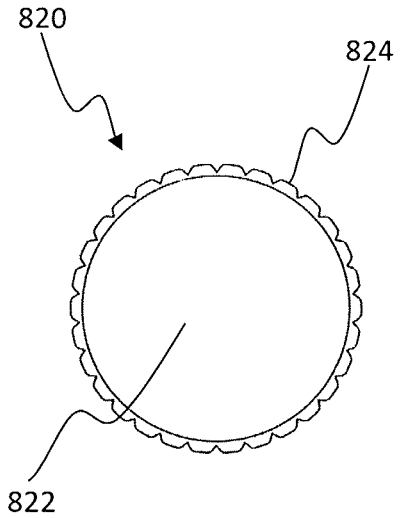
FIG. 9A is an end view of a thumb screw forming part of the detachable hook assembly of FIG. 5, according to an exemplary embodiment of the present invention.
Figure 8B:
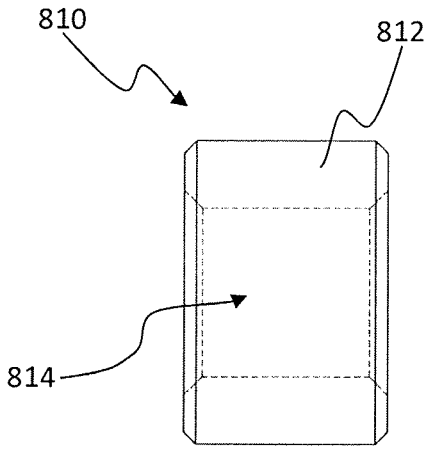
FIG. 8B is a side view of the threaded insert of FIG. 8A, according to an exemplary embodiment of the present invention.
Figure 9B:
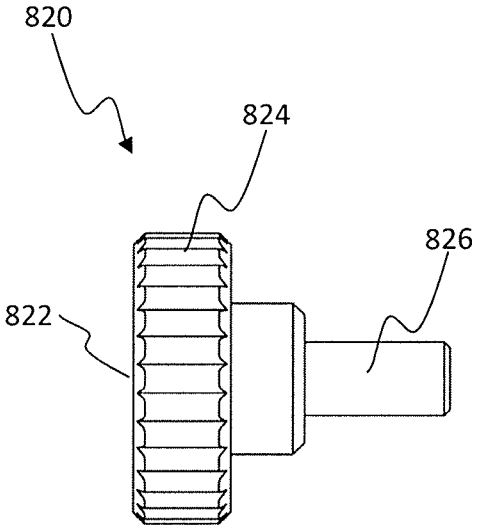
FIG. 9B is a side view of the thumb screw of FIG. 9A, according to an exemplary embodiment of the present invention.

Referring to FIGS. 7A and 7B, the hook 700 may include a curved head 710 sized to be held by a user of the cane 10 and a connecting region 720 for attaching the hook 700 to the bracket 600 (FIGS. 6A and 6B). The connecting region 720 may include a shaft 722 and a foot 724 connected to the shaft 722 by a flexible connecting member 726. The shaft 722 is sized to fit securely but removably within the hook aperture 620 (FIGS. 6A and 6B). The foot is offset from the shaft 722 so that when the connecting region 720 of the handle 700 is inserted into the hook aperture 620, the foot 724 extends beyond the hook aperture 620 and prevents an upward force from removing the hook 700 from the hook aperture 620. The hook 700 may be removed from the hook aperture 620 by pressing the foot 724 inward toward the hook aperture 620, causing the flexible connecting member 726 to bend and aligning the foot 724 with the hook aperture 620.

Although illustrated and described above with reference to certain specific embodiments [and examples], the present invention is nevertheless not intended to be limited to the details shown. Rather, various modifications may be made in the details within the scope and range of equivalents of the claims and without departing from the spirit of the invention.

What is claimed is:

1. A cane comprising:

a hollow shaft having a first end and second end;

a grasping mechanism within the first end of the shaft, the grasping mechanism having a plurality of grasping fingers; and a release mechanism adjacent to the second end of the shaft, the release mechanism having a handle, a trigger within the handle, a release button, a release cylinder adjacent to the release button including a release pin located beneath a portion of the trigger, and a spring between the release button and the release cylinder which maintains tension on the release button, wherein pressing the release button laterally displaces the release pin from beneath the portion of the trigger, resulting in the trigger extending beyond the handle and the grasping finger extending beyond the first end of the shaft so that the grasping fingers are separated by a first distance, and wherein, after pressing the release button, squeezing the handle retracts the grasping fingers towards the first end of the shaft and reduces the distance between the grasping fingers to a second distance less than the first distance.

2. The cane of claim 1, wherein after pressing the release button, squeezing the handle so that the grasping fingers are fully retracted into the first end of the shaft results in the release pin slides back beneath the trigger, whereby the trigger and grasping mechanism are locked into place until the release button is pressed a second time.

3. The cane of claim 1, wherein a first end of the trigger is attached to an end of the handle by a fastener, so that the trigger may pivot within the handle about the fastener.

4. The cane of claim 1, further comprising grasping tips attached to the grasping fingers, wherein the grasping tips comprise a textured or non-skid material to prevent slipping.

5. The cane of claim 1, wherein the grasping fingers are flexible and curved outward from the shaft so that the grasping fingers are separated by the first distance.

6. The cane of claim 1, wherein the first distance is approximately 1.5 inches.

7. The cane of claim 1, further comprising a linkage shaft connecting the trigger of the grasping mechanism to the plurality of grasping fingers of the grasping mechanism.

8. The cane of claim 7, further comprising:

a bushing spring displaced around the linkage shaft;

an upper bushing adjacent to a first end of the bushing spring; and a lower bushing adjacent to a second end of the bushing spring and adjacent to the connection between the linkage shaft and the grasping mechanism, wherein the bushing spring is compressed while the grasping mechanism is stored in the hollow shaft so that when the release button is pressed the bushing spring expands and pushes the grasping mechanism beyond the second end of the shaft.

9. The cane of claim 1, wherein the handle comprises two halves.

10. The cane of claim 1, further comprising a gel insert attached to the handle.

11. A cane comprising:

a hollow shaft having a first end and second end;

a grasping mechanism within the first end of the shaft, the grasping mechanism having a plurality of grasping fingers;

a release mechanism adjacent to the second end of the shaft, the release mechanism having:

a handle, a trigger within the handle, and a release button, wherein pressing the release button extends the trigger beyond the handle and extends the grasping fingers beyond the first end of the shaft so that the grasping fingers are separated by a first distance, and, wherein, after pressing the release button, squeezing the handle retracts the grasping fingers towards the first end of the shaft and reduces the distance between the grasping fingers to a second distance less than the first distance; and a detachable hook assembly having:

a bracket including a bracket body, a hook aperture, a shaft aperture sized to fit around the hollow shaft, and a screw aperture;

a thumb screw assembly which fits in the screw aperture, and may be tightened to increase tension on the hollow shaft a hook which fits into the hook aperture and includes a curved head and a connecting region, the connecting region having a shaft of a diameter approximately equal to a diameter of the hook aperture, a foot offset from the shaft, and a flexible connecting member connecting the shaft to the hook, wherein when the connecting region is inserted into the hook aperture, the foot extends beyond the hook aperture and prevents an upward force from removing the hook from the hook aperture, and wherein the hook may be removed from the hook aperture by pressing the foot inward toward the hook aperture, causing the flexible connecting member to bend and aligning the foot with the hook aperture.

12. A cane comprising:

a hollow shaft having a first end and second end;

a handle attached to the first end of the hollow shaft;

a linkage shaft disposed within the hollow shaft;

a plurality of grasping fingers attached to the linkage shaft adjacent to the second end of the hollow shaft;

a trigger attached to the linkage shaft adjacent to the first end of the hollow shaft, wherein the trigger is within the handle when the cane is in a stored position and extends beyond the handle when the cane is in a use position;

a release button on the handle, a release cylinder adjacent to the release button including a release pin located beneath a portion of the trigger, a spring between the release button and the release cylinder which maintains tension on the release button, wherein pressing the release button laterally displaces the release pin from beneath the portion of the trigger and extends the trigger beyond the handle, thereby moving the trigger from the stored position to the use position, and wherein when the handle is moved from the stored position to the use position, the plurality of grasping fingers extend beyond the second end of the hollow shaft and may be operated by squeezing the trigger.

13. The cane of claim 12, further comprising:

a bushing spring displaced around the linkage shaft;

an upper bushing adjacent to a first end of the bushing spring; and a lower bushing adjacent to a second end of the bushing spring and adjacent to the connection between the linkage shaft and the grasping mechanism, wherein the bushing spring is compressed while the grasping mechanism is stored in the hollow shaft so that when the release button is pressed the bushing spring expands and pushes the grasping mechanism beyond the second end of the shaft.

* * * * *